US010076019B2

(12) United States Patent
Carletti et al.

(10) Patent No.: US 10,076,019 B2
(45) Date of Patent: Sep. 11, 2018

(54) PLASMA TORCH WITH IMPROVED COOLING SYSTEM AND CORRESPONDING COOLING METHOD

(71) Applicant: TRAFIMET S.P.A., Castegnero (VI) (IT)

(72) Inventors: Claudio Carletti, Costermano (IT); Ugo Simioni, Vicenza (IT); Attilio Imi, Pagnacco (IT)

(73) Assignee: Trafimet S.p.A., Castegnero (VI) (IT)

( * ) Notice: Subject to any disclaimer, the term of this patent is extended or adjusted under 35 U.S.C. 154(b) by 0 days.

(21) Appl. No.: 14/916,587

(22) PCT Filed: Aug. 27, 2014

(86) PCT No.: PCT/IB2014/064092
§ 371 (c)(1),
(2) Date: Mar. 4, 2016

(87) PCT Pub. No.: WO2015/033252
PCT Pub. Date: Mar. 12, 2015

(65) Prior Publication Data

US 2016/0219688 A1 Jul. 28, 2016

(30) Foreign Application Priority Data

Sep. 5, 2013 (IT) ..... VI2013A0220

(51) Int. Cl.
*B23K 10/00* (2006.01)
*H05H 1/34* (2006.01)
*H05H 1/28* (2006.01)

(52) U.S. Cl.
CPC ..... *H05H 1/34* (2013.01); *H05H 1/28* (2013.01); *H05H 2001/3436* (2013.01); *H05H 2001/3489* (2013.01)

(58) Field of Classification Search
CPC .... H05H 1/34; H05H 1/28; H05H 2001/3436; H05H 2001/3489
(Continued)

(56) References Cited

U.S. PATENT DOCUMENTS 4,625,094 A * 11/1986 Marhic ..... H05H 1/28 219/121.48
4,748,312 A * 5/1988 Hatch ..... H05H 1/28 219/121.49
(Continued)

FOREIGN PATENT DOCUMENTS

CN 87103736 A 12/1988
CN 2084403 U 9/1991
(Continued)

OTHER PUBLICATIONS

State Intellectual Property Office (SIPO) of the People's Republic of China, First Office Action in CN application No. 201480048771.6, which is a patent family member of U.S. Appl. No. 14/916,587.
(Continued)

*Primary Examiner* — Mark Paschall
(74) *Attorney, Agent, or Firm* — Robert Lelkes

(57) ABSTRACT

The invention is a plasma torch (1; 101; 201) of the type comprising: a first element (20) provided with a through opening (21) serving as an outlet for a plasma flow; a hollow electrode (19) that is developed longitudinally along a main axis (X) and is suited to be positioned with respect to said first element (20) in such a way as to define a striking area, of the type comprising a hollow cavity (25) that extends at least partially along the main axis (X); a first conveyance way (51, 52, 53) suited to convey a carrier gas towards said striking area; a second conveyance way (56, 56*a*, 56*b*) suited to convey a portion of the carrier gas towards the inner cavity (25) of the hollow electrode (19), the portion of the carrier gas being suited to cool the hollow electrode (19).
(Continued)

This torch comprises conveyance means (59, 60*a*, 60*b*) suited to convey the carrier gas from the inner cavity (25) of the hollow electrode (19) towards a way so as not to affect the striking area. The invention concerns also a method of operation of a plasma torch (1; 101; 201).

14 Claims, 9 Drawing Sheets

(58) Field of Classification Search
USPC ..... 219/121.5, 121.51, 121.52, 121.49
See application file for complete search history.

(56) References Cited

U.S. PATENT DOCUMENTS 5,013,885 A 5/1991 Carkhuff et al.
5,214,262 A * 5/1993 Carkhuff ..... H05H 1/34 219/121.48
5,859,403 A * 1/1999 Zigliotto ..... H05H 1/28 219/121.49

FOREIGN PATENT DOCUMENTS

EP 1993331 A 11/2008
EP 2418921 A1 2/2012
FR 2839606 A1 11/2003
JP H05-237665 A 9/1993

OTHER PUBLICATIONS

Ministero dello Sviluppo Economico, Opinione Scritta for Italian patent application No. ITVI20130220, which is the priority application for international application No. PCT/IB2014/064092 on which U.S. Appl. No. 14/916,587 is based.

* cited by examiner 1
17
11
51
34
26b
26
33
2a
26a
32
11a
31
41
41
12b
39
40
37
36a
59
61
12
60b
60a
37
12a
58
52
36b
16a
18
14
56b
56
53
56a
17b
42
22
25
16
66
66
19
16b
55
20
19a
15
54

15a
X
21

PLASMA TORCH WITH IMPROVED COOLING SYSTEM AND CORRESPONDING COOLING METHOD

TECHNICAL FIELD OF THE INVENTION

The present invention concerns the production of a plasma torch used in industrial applications.

In particular, the present invention concerns the cooling system used to cool the components of said torch.

The present invention concerns also a device using said torch.

DESCRIPTION OF THE STATE OF THE ART

The use of technology for the treatment of materials, typically of metallic materials, is known in various sectors, and in particular in the industrial sector. These treatments typically consist in the cutting and/or marking of the materials. The known technologies include the use of special plasma devices used by specialized operators to treat the material.

These devices of known type exploit the effect deriving from the generation of an electric arc between two electrodes, known as cathode and anode. The device generates a plasma flow that is sent out of a nozzle following the application of a suitable difference in potential and the striking of the are between the two electrodes between which a carrier gas, typically air, is conveyed. The carrier gas is subjected to ionization to generate said plasma.

Said devices comprise, for this purpose, an element suited to be handled by the operator, known as torch, at the end of which there is a nozzle provided with an opening that collimates and conveys the plasma flow towards the outside.

In a first type of torches, known for example as transferred arc torches, the arc is initially struck between an electrode, the cathode, positioned in the torch, and the nozzle that therefore initially serves as an anode. Once the initial striking step has been completed, the function of serving as an anode is transferred to the piece being processed, while the nozzle serves only as a collimator and conveyor of the plasma flow.

In a second type of torches, known as non-transferred arc torches, instead, the nozzle always serves as an anode, during both the initial striking step and the operation of the torch while the piece is being processed.

In metal cutting applications, considered the higher energy density transferred to the piece, the configuration with transferred arc is adopted, while the configuration with non-transferred arc remains the compulsory choice when processing non-metallic materials.

The plasma flow, in any case, is generated through interaction with the flow of carrier gas that is properly conveyed at the level of the electrodes.

For its operation, the device is thus constituted by a first unit, or generator, suited to supply power to the torch in order to generate and maintain the arc, and by a unit suited to feed the torch with the carrier gas.

According to the known technique, the end of the torch is thus provided with a first element, or nozzle, provided with an opening through which the plasma flow is ejected in the form of a jet. As explained above, the first element also serves as to an anode in the generation and/or maintenance of the plasma. At the end of the torch there is, furthermore, a second internal element or electrode (cathode) that is the other electrode for the generation of plasma. The internal electrode is typically arranged in a coaxial position inside the nozzle.

In a first category of torches of known type, the internal electrode can slide axially with respect to the nozzle under the influence of an elastic force usually generated by a spring. The axial movement of the internal electrode is such as to define, first of all, a first non-striking position with the internal electrode in contact with the nozzle and thus a position in which no plasma flows out of the nozzle. The axial movement of the internal electrode against the thrusting force of the spring and away from the nozzle is such as to successively define a second striking position in which the internal electrode is arranged at a suitable distance from the nozzle and the plasma jet can flow out of the opening provided in the nozzle when the carrier gas is conveyed therein.

The internal electrode is usually moved away from the nozzle against the thrusting force of the spring by properly conveying the same flow of carrier gas against suitable surfaces of the internal electrode or, more particularly, against suitable surfaces of a piston that carries the electrode itself.

In a different category of torches of known type, the internal electrode and the nozzle are maintained at a suitable fixed striking distance. In order to generate the plasma jet that is sent out of the nozzle, the carrier gas is conveyed between the two electrodes and power is properly supplied to the two electrodes in order to generate an alternate electric field and therefore a high-frequency jump spark between them.

Independently of the type of torch being used, owing to the high temperatures present in the striking area at the level of the electrodes, the making of the electrodes is a particularly important aspect for the operation of the torch and the duration of the same.

The electrodes, and in particular the internal electrode, in fact, wear out very quickly.

In particular, the electrodes wear out due to several factors: the high intensity of the current that powers the arc during the cutting steps and heats the electrode; the frequency of the start/stop cycles; the heat irradiated by the piece being processed towards the electrode itself.

For this purpose, according to the known technique, during operation the to electrodes are subjected to a cooling process. Special attention is paid to the making and cooling of the internal electrode.

In a first category of torches, the internal electrode is of the hollow type. This solution uses a smaller quantity of material, typically copper, compared to the solutions using solid electrodes. Advantageously, the solution using hollow internal electrodes is less expensive. The electrode, however, is subjected to high wear over time due, in particular, to the high temperatures involved. In order to increase the useful life of the internal electrode, a cooling system is used that consists in conveying at least part of the flow of carrier gas, before the arc is struck, into the cavity present inside the electrode. The carrier gas cooling flow touches the inner walls of the cavity of the electrode, thus causing the electrode to cool down. According to the known technique, furthermore, the cooling flow that affected the inner cavity of the electrode is then conveyed again towards the outside and passes through the striking area where the plasma is generated, and thus towards the outlet opening of the nozzle.

The cooling system of the known type described above, however, poses some drawbacks.

A drawback posed by this type of cooling is constituted by the fact that the cooling action is not effective, as the flow of cooling gas leaving the hollow electrode has been subjected to a heating effect and returns towards the striking area between the electrodes.

The effect of the cooling gas temperature is thus added to the effect of the temperature in the striking area.

A further drawback posed by the systems of the known type is represented by the high wear to which the electrodes, in particular the internal electrode, are subjected, especially at the level of the striking area.

A further drawback of the systems of the known type is constituted by the scarce effectiveness of the plasma, which is due to the increased temperature of the carrier gas that is ionized. It is known, in fact, that the lower the temperature of the ionized gas, the higher the density of the plasma. A temperature increase, therefore, leads to lower density and thus lower effectiveness of the plasma.

It is the object of the present invention to at least partially overcome the drawbacks described above.

It is a first object of the present invention to provide a plasma torch having a cooling system that is more effective than the systems of the known type, at the same time guaranteeing a low-temperature flow of gas to be ionized in order to generate high density plasma.

It is another object of the present invention to provide a plasma torch that requires fewer maintenance operations and/or electrode replacements, in particular of the internal electrode, compared to the torches of known type.

It is a further object of the present invention to provide a plasma torch that makes it possible to obtain high capacity of cutting air so as to ensure higher cutting speeds and thus better quality of the cut piece (meaning with reduced burrs).

It is a further object of the present invention to provide a plasma torch in which the plasma is more effective than in the torches of known type.

SUMMARY OF THE PRESENT INVENTION

The general concept on which the present invention is based has been developed from the idea of providing a plasma torch comprising a hollow electrode and equipped with a system for cooling the hollow electrode by conveying a cooling fluid in its inner cavity, wherein the cooling fluid is at least partially sent out of the torch once it has crossed the inner cavity of the electrode.

According to a first aspect of the present invention, the same concerns, therefore, a plasma torch of the type comprising:

- a first element provided with a through opening serving as an outlet for a plasma flow;
- a hollow electrode that develops longitudinally along a main axis and can be positioned with respect to said first element in such a way as to define a striking area, said hollow electrode being of the type comprising an inner cavity that extends at least partially along said main axis;
- a first conveyance way suited to convey a carrier gas towards said striking area;
- a second conveyance way suited to convey a portion of said carrier gas towards said inner cavity of said hollow electrode, said portion of said carrier gas being suited to cool said hollow electrode, wherein the torch comprises means for conveying said carrier gas from said inner cavity of said hollow electrode towards a way so as not to affect said striking area.

Preferably, the conveyance means convey the carrier gas from the inner cavity of the hollow electrode towards the outside of the torch, in such a way as to avoid interfering with the striking area.

Preferably, the inner cavity of the hollow electrode substantially extends over the entire length of the hollow electrode itself.

In a preferred embodiment of the invention, the hollow electrode constitutes the cathode of the torch.

In a preferred embodiment of the invention, the hollow electrode constitutes the cathode of the torch and the first element constitutes the anode of the torch during the striking step. In said embodiment of the invention, once said striking step has been completed the first element is not the anode of the torch any longer and the function of serving as an anode is transferred to and defined by the piece being processed.

In another preferred embodiment of the invention, the hollow electrode constitutes the cathode of the torch and the first element constitutes the anode of the torch in all the processing steps.

According to a preferred embodiment of the invention, the hollow electrode can be moved and can be positioned between at least one first operating position and at least one second operating position. In the first operating position, the hollow electrode is in contact with the first element and in the second operating position the hollow electrode is spaced from the first element in such a way as to define the striking area.

The torch properly comprises means for moving the hollow electrode between the first operating position and the second operating position.

Preferably, the moving means comprise at least one piston suited to support the hollow electrode and elastic thrusting means suited to arrange the hollow electrode in the first operating position.

According to another preferred embodiment of the invention, the hollow electrode is in a fixed position with respect to the first element.

Preferably, the torch comprises a third conveyance way suited to convey a portion of the carrier gas towards the first element, said portion of carrier gas being suited to cool the first element.

In another preferred embodiment of the invention, the torch also comprises a further conveyance way suited to convey the carrier gas from the inner cavity of the hollow electrode towards the striking area.

The torch suitably comprises power supply means suited to power the hollow electrode.

The torch suitably comprises power supply means suited to power the first element.

Preferably, the torch comprises also means for feeding the carrier gas.

According to a second aspect of the present invention, the same concerns a device for the generation of plasma comprising a plasma torch, wherein the torch is made as described above.

Preferably, said device comprises power supply means for said torch.

Preferably, said device comprises carrier gas feeding means for said torch.

According to a third aspect of the present invention, the same concerns an operating method for a plasma torch of the type comprising:

- a first element provided with a through opening serving as an outlet for a plasma flow;
- a hollow electrode that develops longitudinally along a main axis and is positioned with respect to said first element in such a way as to define a striking area, said hollow electrode being of the type comprising an inner cavity that extends at least partially along said main axis;

a first conveyance way suited to convey a carrier gas towards said striking area;

a second conveyance way suited to convey a portion of said carrier gas towards said inner cavity of said hollow electrode, said portion of said carrier gas being suited to cool said hollow electrode, said method comprising at least the following steps:

conveying said carrier gas towards said striking area through said first conveyance way;

conveying a portion of said carrier gas towards said inner cavity of said hollow electrode through said second conveyance way in order to cool said hollow electrode;

conveying at least part of said carrier gas from said inner cavity of said hollow electrode towards a way so as not to affect said striking area.

Preferably, according to the method at least part of the carrier gas is conveyed from the inner cavity of the hollow electrode towards the outside of said torch in such a way as to avoid any interference with the striking area.

More preferably, according to the method, the entirety of said portion of said carrier gas is conveyed from said inner cavity of said hollow electrode towards a way so as not to affect said striking area.

BRIEF DESCRIPTION OF THE DRAWINGS

Further advantages, objects and characteristics of the present invention are defined in the claims and are illustrated here below through the following to description, with reference to the attached drawings. In particular, in the drawings:

DETAILED DESCRIPTION OF THE PRESENT INVENTION

Figure 1:
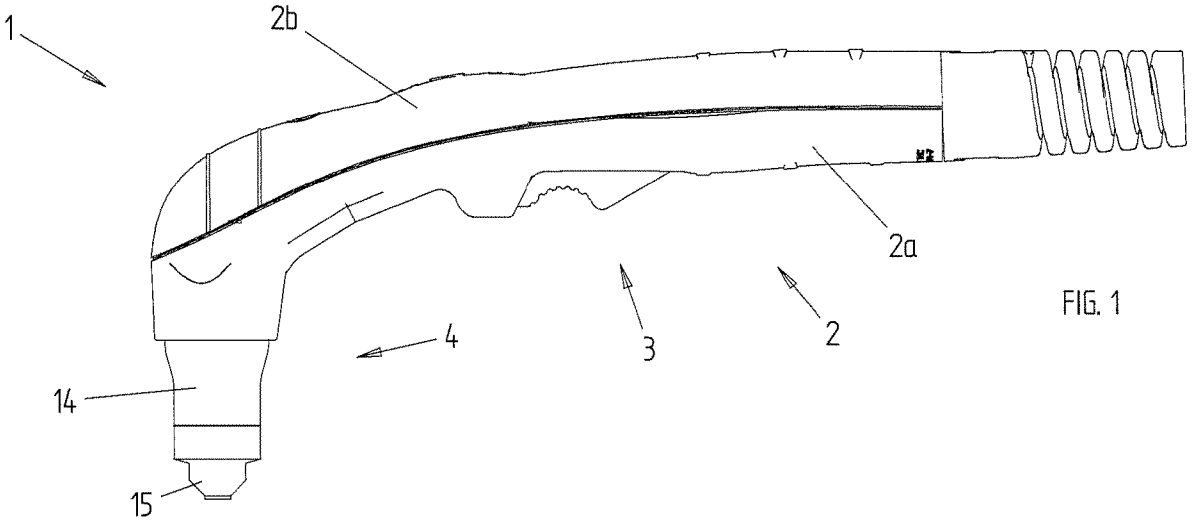
FIG. 1 shows a side plan view of a torch according to a preferred embodiment of the present invention.

Although the present invention is described here below with reference to its embodiments shown in the drawings, the present invention is not limited to the specific embodiments described here below and shown in the figures. On the contrary, the embodiments described and illustrated herein clarify some aspects of the present invention, the scope of which is defined in the claims.

The present invention has proven to be particularly advantageous with reference to the manufacture of plasma torches of the type with transferred arc using a gas cooling system. It should however be noted that the present invention is not limited to the manufacture of torches of that type. On the contrary, the present invention can be conveniently applied in all the cases in which gas-cooled plasma torches are used, for example also in the case of plasma torches with non-transferred arc.

Figure 2:
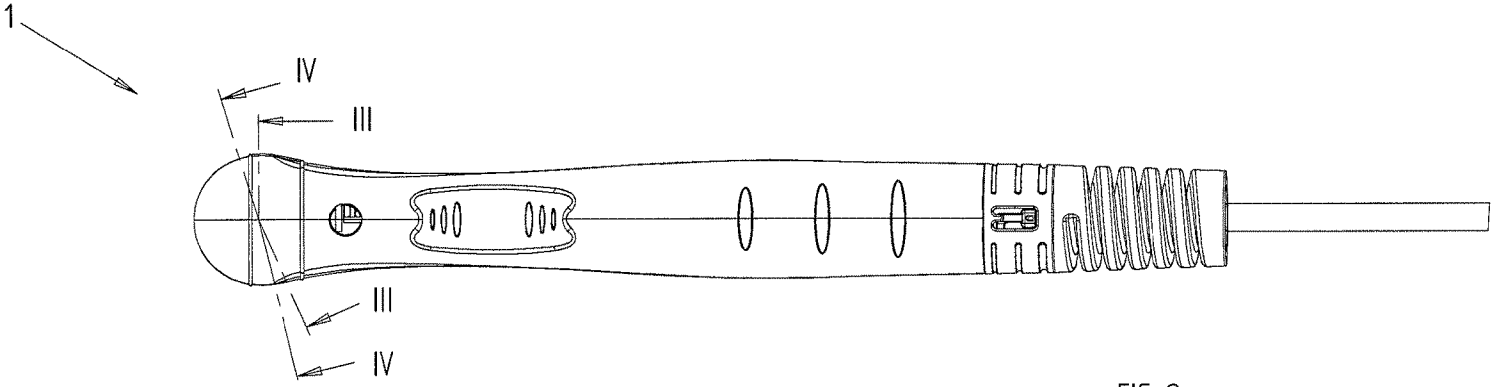
FIG. 2 shows a top view of FIG. 1.

FIGS. 1 and 2 show a torch according to a preferred embodiment of the invention, indicated as a whole by 1.

The torch 1 is the handy element of a plasma treatment device, not illustrated herein, also comprising a power supply unit and a carrier gas feeding unit for the torch 1.

In particular, it is the handy element of a plasma cutting device.

The carrier gas preferably comprises air and is conveyed to the torch 1 through a suitable duct.

The carrier gas is preferably thrust under pressure towards the torch 1 and the carrier gas feeding unit is advantageously constituted by an air compressor and/or a compressed air tank.

In variant embodiments of the invention, however, the carrier gas can be of a different type, like for example air, nitrogen (N2), an argon-nitrogen mixture (for example 65% argon and 35% nitrogen), oxygen (O2), etc.

The torch 1 preferably comprises an area 2 suited to be held by the operator, a start switch 3 and an end portion 4 where the plasma is generated.

The grip area 2 preferably comprises two half-shells, a lower half-shell 2*a* and an upper half-shell 2*b*, coupled together.

In variant embodiments of the invention the grip area can be made in a different way, for example it may comprise two half-shells, a right one and a left one, coupled together, or it may preferably comprise a single tubular shell.

In the following part of this description particular reference is made to the end portion 4 of the torch 1, with particular reference to Figures from 3 to 6.

In this end portion 4 of the torch 1 it is possible to identify a first supporting body 11 and a second supporting body 12 coupled together, preferably through the interposition of a first sealing ring (O-ring) 31.

The second supporting body 12 is advantageously coupled in a fixed manner with the lower half-shell 2*a* of the grip area 2.

A shell 14 is coupled with the lower part of the second supporting body 12. The shell 14 projects from the underside of the lower half-shell 2*a*, as can be observed in FIG. 1.

A closing cap 15 provided with an opening 15*a* is coupled with the shell 14. The closing cap 15 is coupled with the shell 14 preferably by screwing it thereon. It is obvious that in variant embodiment of the invention this coupling action can be obtained in a different manner.

The shell 14 accommodates a first sleeve 16 suited to be coupled with the lower end 12*a* of the second supporting body 12, preferably through a thread 16*a*.

The lower portion 16*b* of the first sleeve 16 accommodates and supports a nozzle 20 provided with an opening 21 from which the carrier gas can be diffused towards the outside after ionization, as is explained in greater detail below.

In the embodiment illustrated herein, the nozzle 20 constitutes a first element intended to collimate and convey the plasma flow. The nozzle 20, furthermore, is properly piloted so that it serves as an anode in the initial striking step for the generation of plasma from the carrier gas through ionization. This function of serving as an anode is then transferred to the piece being processed, while the nozzle 20 serves only as a collimator and conveyor of the plasma flow.

During the different striking and processing steps, the torch 1 is managed and piloted by a control unit (not shown in the figures).

The nozzle 20 is preferably made of a conductor material, preferably with high resistance to heat, in particular resistance to high temperatures. The nozzle 20 is preferably made of copper. In variant embodiments of the invention, the nozzle is made of a copper alloy, or a copper alloy whose surface is subjected to a treatment intended to increase its hardness and resistance to the molten material resulting from the cutting operation. In other variant embodiments also the use of brass may be taken in consideration.

A second sleeve 22 associated with the upper side of the nozzle 20 extends inside the first sleeve 16.

An internal electrode 19 is positioned coaxially inside the second sleeve 22. The internal electrode 19 of the embodiment described herein constitutes the second electrode (cathode) prepared for the generation of the electric arc and of the plasma from the carrier gas through ionization.

In variant embodiments of the invention, like for example in the case of a torch with non-transferred arc technology, the internal electrode will serve as a cathode while the first element constituted by the nozzle 20 will serve as an anode during both the initial striking step and the piece processing step.

The internal electrode 19 develops along a main axis X and is hollow.

In fact, the electrode 19 comprises a cavity 25 that develops along said main axis X.

The cavity 25 preferably and substantially extends over the entire length of the electrode 19.

In variant embodiments of the invention, however, the shape and size of said cavity can be different from those described herein.

Preferably, the end 19*a* of the internal electrode 19 extends at least partially inside the nozzle 20.

The internal electrode 19 preferably slides along the main axis X. This is obtained by using a piston 17 coupled with the internal electrode 19. The piston 17 substantially develops along the main axis X and is maintained thrust towards the nozzle 20 by elastic thrusting means 26. The elastic thrusting means 26 preferably comprise a spiral spring 26.

Figure 3:
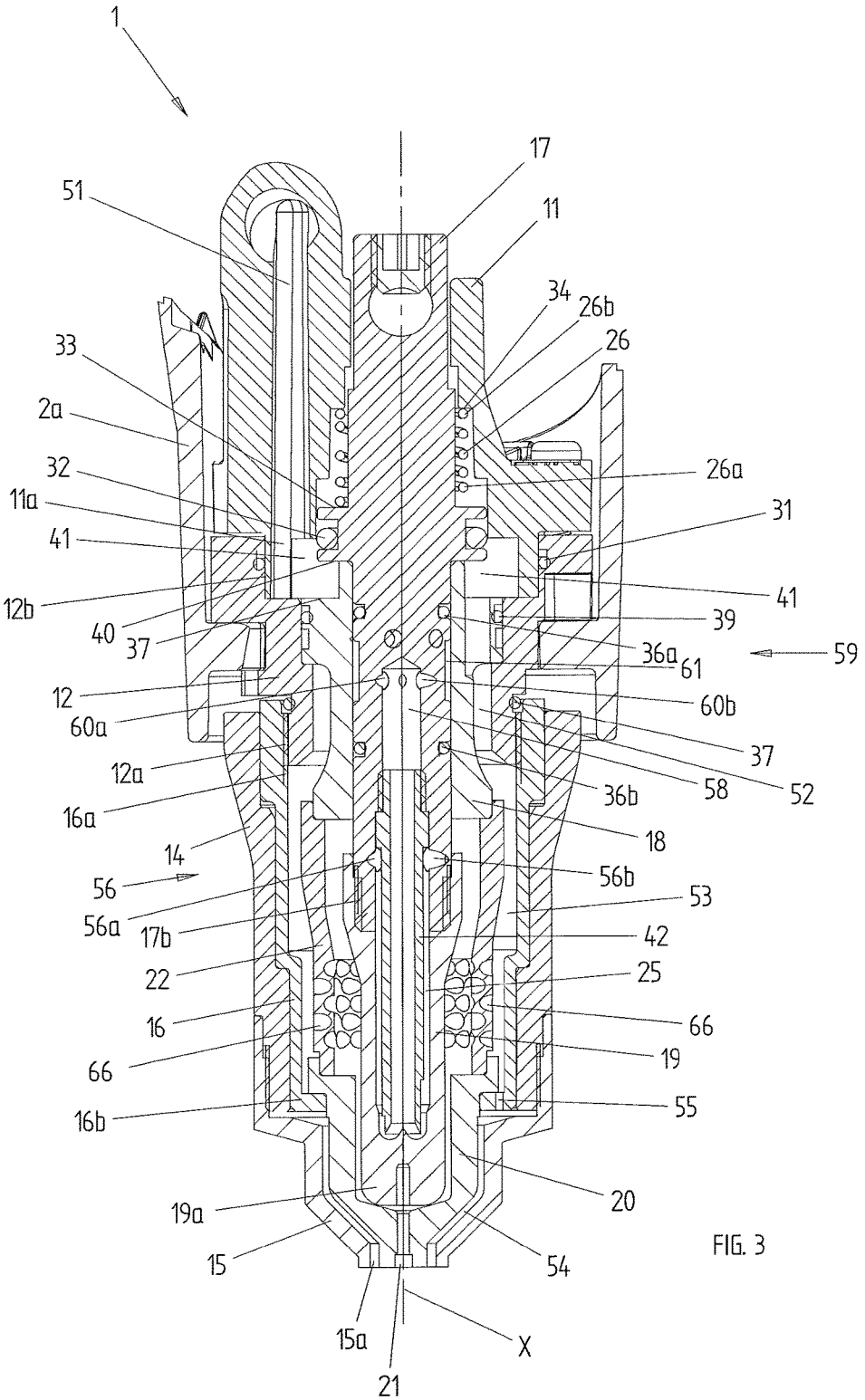
FIG. 3 shows a cross-sectional view along line of FIG. 2 with the torch in a first operating position.

The piston 17 and the internal electrode 19 can assume, in particular, a first operating configuration, shown in FIG. 3, in which the spiral spring 26 exerts its thrusting action and the internal electrode 19 is in contact with the inner surface of the nozzle 20.

In said first operating configuration, the opening 21 of the nozzle 20 is substantially blocked and the two electrodes, the anode constituted by the nozzle 20 and the cathode constituted by the internal electrode 19, are electrically in contact with each other and in a non-striking condition.

Figure 4:
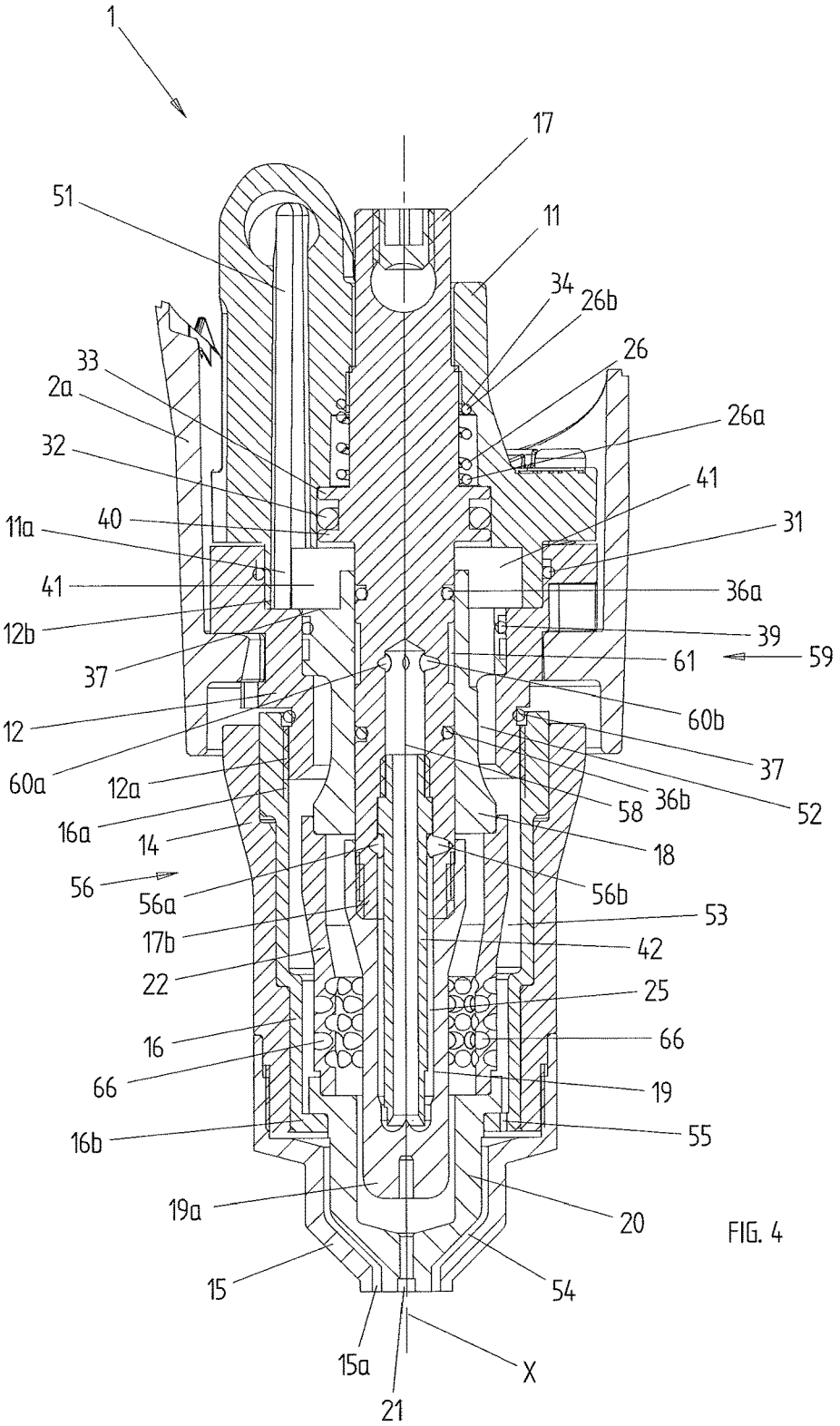
FIG. 4 shows a cross-sectional view along line of FIG. 2 with the torch in a second operating position.
Figure 5:
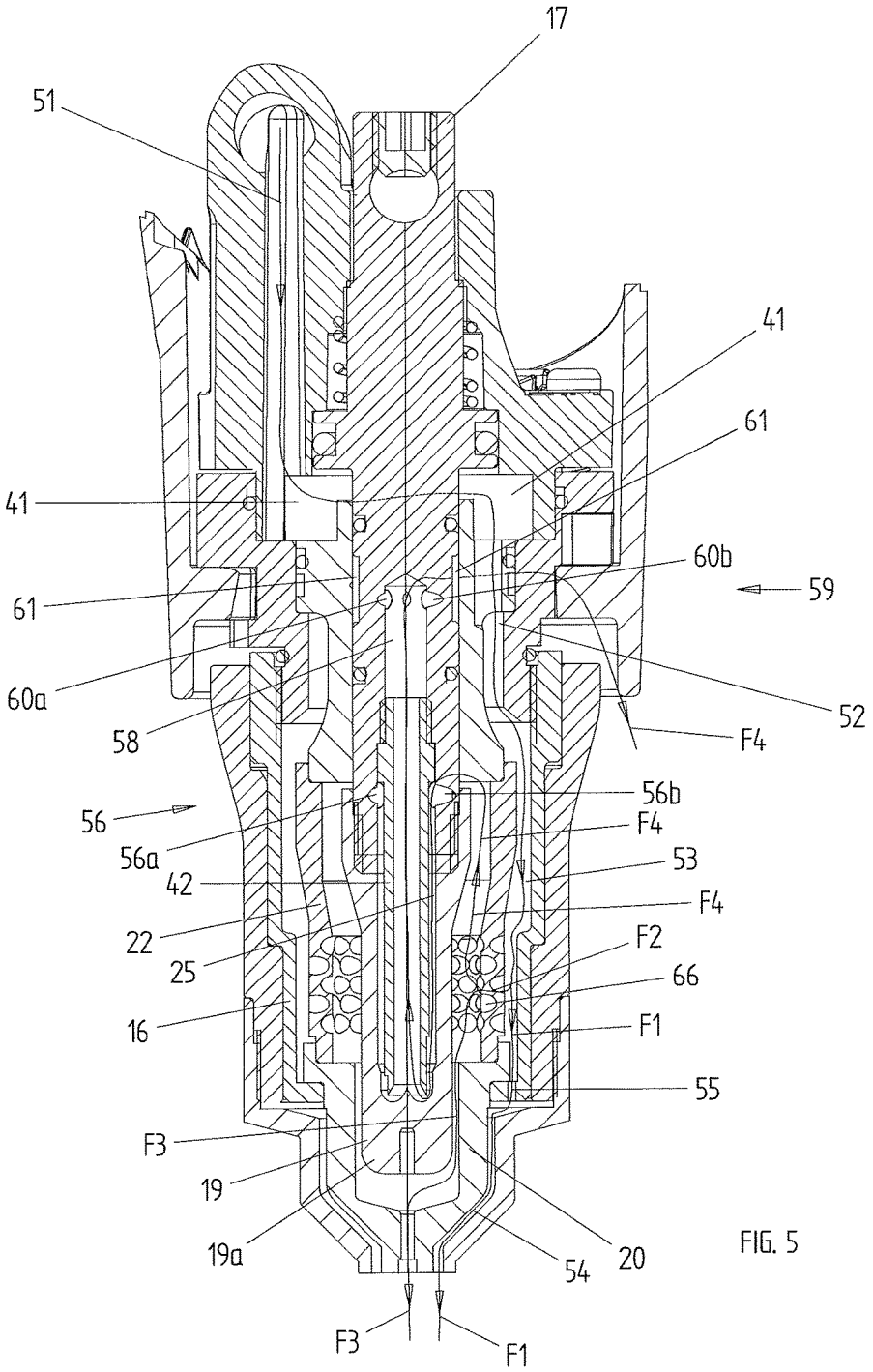
FIG. 5 shows the same view shown in FIG. 4, illustrating some flows during the operation of the torch in the second operating position.
Figure 6:
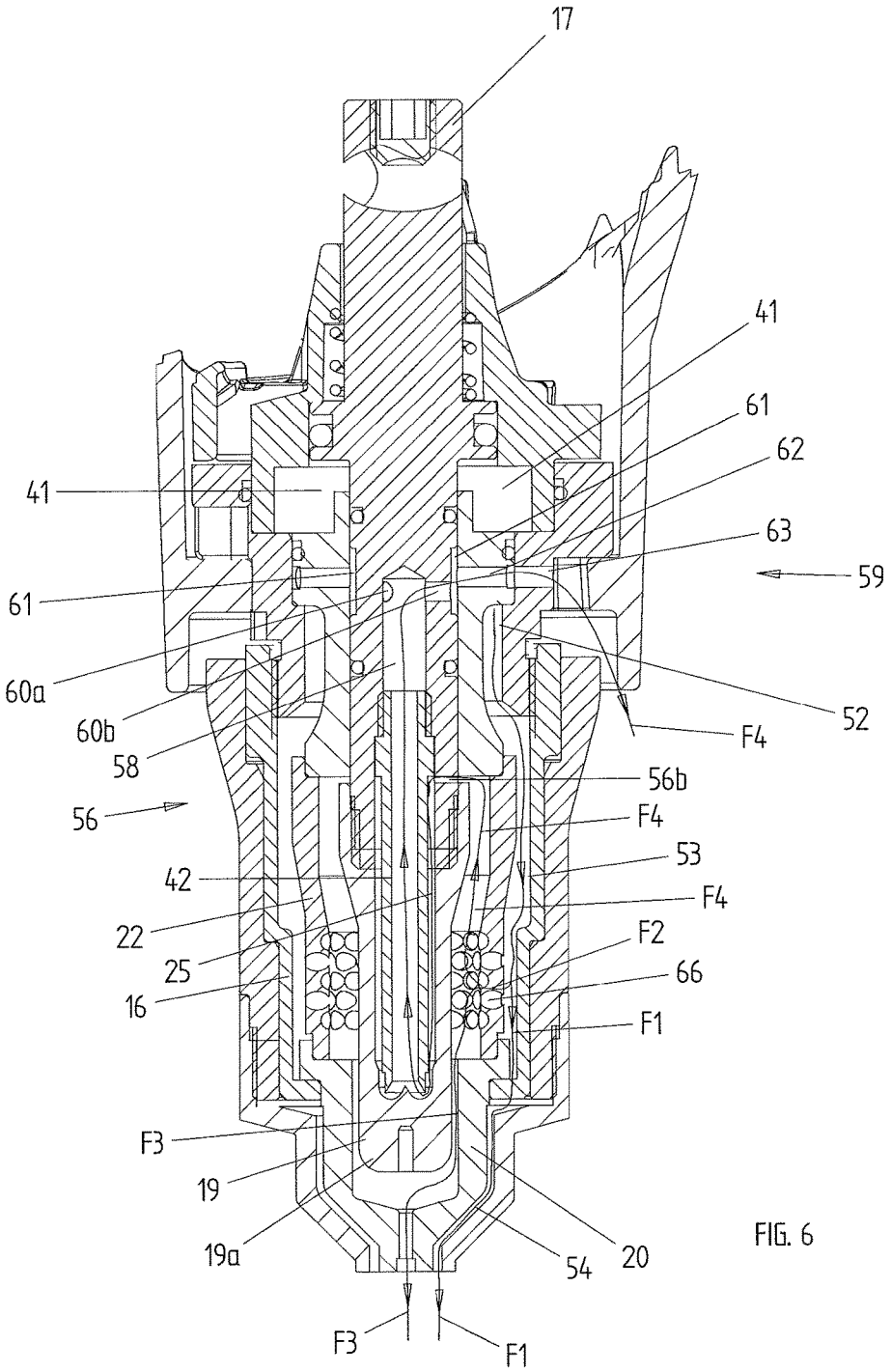
FIG. 6 shows a cross-sectional view along line IV-IV of FIG. 2 with the torch in the second operating position, illustrating some flows during the operation of the torch.
Figure 7:
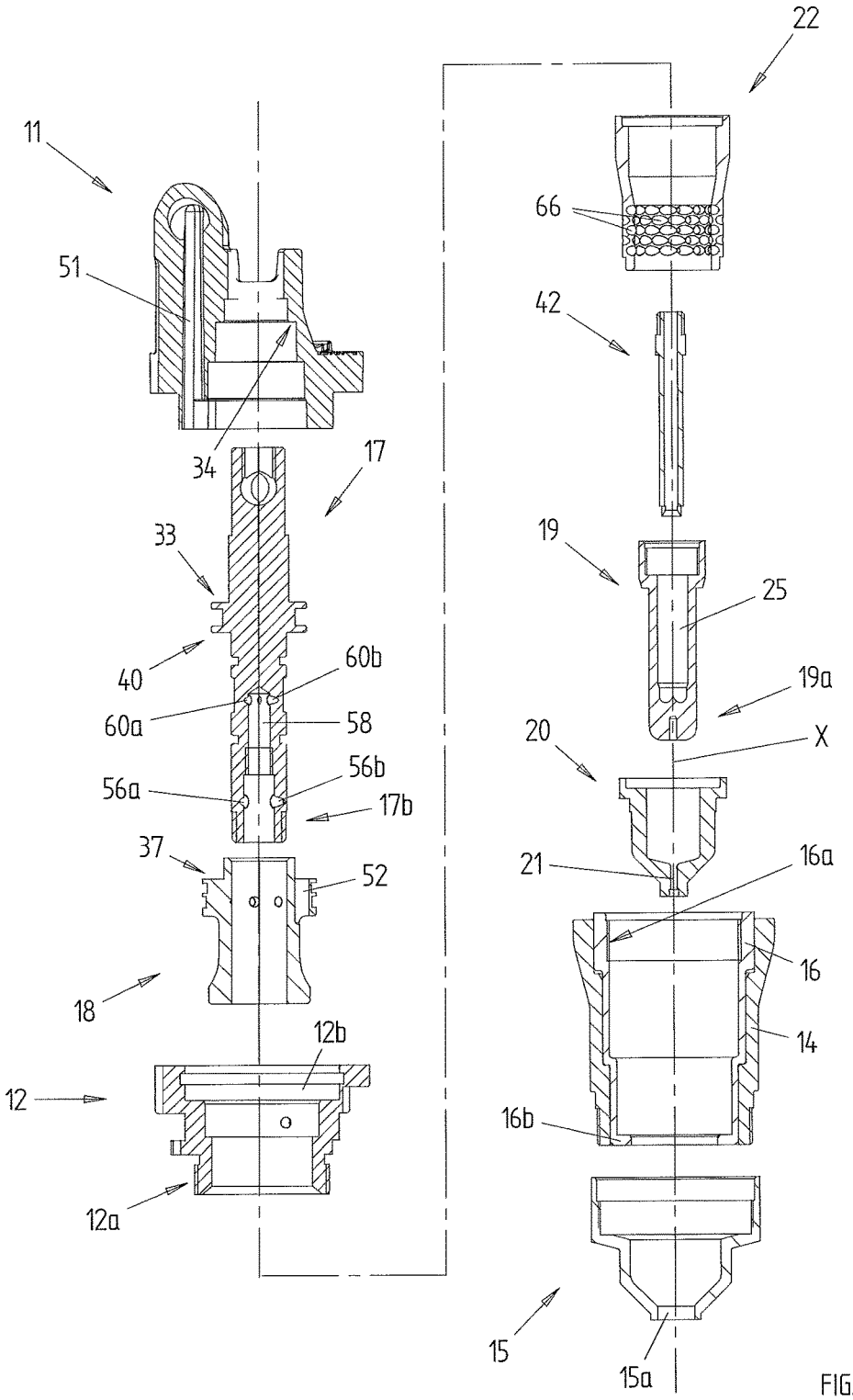
FIG. 7 shows an exploded view of FIG. 3.

The piston 17 and the internal electrode 19 can then assume a second operating configuration, shown in FIGS. 4, 5 and 6, in which the spiral spring 26 is compressed and the internal electrode 19 is at a proper distance from the inner surface of the nozzle 20. This distance constitutes the electric arc striking distance between the two electrodes 20, 19. In this second operating configuration, the opening 21 is free and, with the torch in operation, the plasma flow can move towards the outside once the electric arc has passed onto the material to be cut.

The first and second operating configurations assumed by the two electrodes 20, 19 are obtained through procedures that are illustrated below.

Advantageously, the piston 17 is slidingly housed inside the first supporting body 11. A sealing element 32, preferably an O-ring, is advantageously interposed between the piston 17 and the supporting body 11.

A first annular portion 33 is advantageously defined on the external surface of the piston 17, and the lower end 26*a* of the spiral spring 26 abuts against said first annular portion 33. The other end 26*b* of the spiral spring 26 advantageously abuts against a reference edge 34 of the first supporting body 11.

In its centre portion, furthermore, the piston 17 is preferably slidingly supported by a centre bushing 18.

The piston 17 is coupled with the inside of the centre bushing 18, preferably through the interposition of a pair of sealing elements 36*a*, 36*b*, preferably O-rings.

The centre bushing 18 is coupled with the inside of the second supporting body 12, preferably through the interposition of a sealing element 39, preferably an O-ring.

In variant embodiments of the invention several sealing elements, preferably several O-rings, may be interposed.

The piston 17 can slide inside the centre bushing 18, in particular between said first operating position and said second operating position.

The centre bushing 18 comprises an annular edge 37 at its top. An annular chamber 41 is defined between the annular edge 37 of the centre bushing 18, the inner surface 11*a* of the first supporting body 11, the inner surface 12*b* of the second supporting body 12 and a second annular edge 40 of the piston 17.

At this point it should be noted that all the elements described herein and shown, in particular, in the exploded view of FIG. 6 substantially develop around the main axis X. So, they substantially are tubular elements and/or elements with cylindrical development. Consequently, any gaps or air spaces between them, like for example said chamber 41, assume an annular shape around said main axis X.

A tubular conveyance element 42 is positioned coaxially inside the internal electrode 19 in the cavity 25. Preferably, said tubular conveyance element 42 is connected to the lower end 17*b* of the centre piston 17 and preferably extends substantially over the entire length of the inner cavity 25 of the internal electrode 19.

In variant embodiments of the invention, however, the tubular conveyance element can have shapes and sizes different from those illustrated herein.

Part of the elements illustrated and described above are advantageously provided with suitable conveyance ducts or ways suited to allow the carrier gas to be conveyed for the operation of the torch, as described below.

In addition to conveying the carrier gas, the elements that make up the torch 1 also guarantee the electrical connection of the anode (nozzle 20) and the cathode (internal electrode 19) to the power supply unit. The details of these connections are neither described herein nor illustrated in the drawings.

The electrical connection of the nozzle 20 to the power supply unit is, in any case, guaranteed by the electrical continuity provided by the material of which the first sleeve 16 and the second supporting element 12 are made, the latter being properly connected to an electric cable, not shown herein, coming from the power supply unit.

The electrical connection of the internal electrode 19 to the power supply unit is guaranteed by the electrical continuity provided by the material of which the piston 17 is made, the latter being properly connected to an electric cable, not shown herein, coming from the power supply unit. Furthermore, the material of which the centre bushing 18 and the second sleeve 22 are made makes it possible to obtain and guarantee the necessary electrical insulation between the two electrodes (cathode and anode 20, 19).

In the first supporting body 11 there is a first way 51 suited to deliver the carrier gas coming from the feeding unit through the grip area 2 of the torch 1. The first way 51 preferably comprises a first duct 51.

The first duct 51 conveys the compressed air to the annular chamber 41. The compressed air present in said annular chamber 41 thrusts against the annular edge 40 of the piston 17. The piston 17 is thus thrust against the force of the spiral spring 26 and the torch 1 is thus brought from the first non-striking operating configuration, shown in FIG. 3, to the second striking operating configuration, shown in Figures from 4 to 6.

The air is conveyed from the annular chamber 41 through a second way 52, created in the centre bushing 18, in its lower part, towards the air space 53 defined between the first sleeve 16 and the second sleeve 22. The second way 52 preferably comprises a second duct 52.

From said air space 53 the air flow is divided into a first flow, indicated by F1 in FIG. 5, and a second flow, indicated by F2 in the same FIG. 5.

The first flow F1 reaches the air space 54 defined between the closing cap 15 and the nozzle 20 through a third way 55 created in the lower end 16*b* of the first sleeve 16. The third way preferably comprises a third duct 55.

The first flow F1 of compressed air advantageously constitutes a cooling flow for the nozzle 20. In variant embodiments of the invention, the first cooling air flow for the nozzle may be absent and be replaced by another fluid, for example water or other cooling fluids.

The second flow F2 reaches the inside of the second sleeve 22 through openings 66 defined in the side walls of the second sleeve 22 itself.

The openings 66 are preferably and properly shaped in such a way as to transmit a rotational movement, in order to create the swirling movement of the air that allows the plasma to exert its penetrating action on the piece to be cut.

Inside the second sleeve 22 the second air flow F2 is divided, in its turn, into a third air flow, indicated by F3 in FIGS. 5 and 6, and a fourth air flow, indicated by F4 in the same FIGS. 5 and 6.

The third flow F3 is conveyed between the nozzle 20 and the internal electrode 19 and therefore towards the opening 21. Said third flow F3 defines the flow of the gas suited to be ionized by the action of the electric arc in the striking area between the nozzle 20 and the internal electrode 19 for the generation of the plasma. The plasma then flows out of the opening 21, towards the outside.

The fourth flow F4 is conveyed inside the cavity 25 of the second electrode 19 through a fourth way 56. In the embodiment illustrated herein said way 56 is defined by two ducts 56*a* and 56*b* created at the level of the lower end 17*b* of the piston 17.

The two ducts 56*a* and 56*b* are partially visible in FIGS. 3, 4, 5 and 7 due to the special section plane III-III selected, while in FIG. 6 it is possible to observe the right duct 56*b* in its entirety thanks to the different section plane IV-IV selected.

In variant embodiments of the invention said way may be defined by a different number of ducts, and even by a single duct.

Inside the cavity 25 the fourth flow F4 runs inside the electrode 19 substantially over its entire length, flowing outside the tubular conveyance element 42 until it is in proximity to the lower end 19*a* of the electrode 19. Along this route, the air flow serves as a cooling fluid suited to cool the inner surfaces of the electrode 19 that it touches.

The fourth flow F4 is then conveyed from the lower end of the tubular conveyance element 42 towards an inner cavity 58 of the piston 17.

According to the present invention, means 59 are provided that are suited to convey and expel towards the outside the fourth flow F4 constituted by the heated air coming from the cavity 25 of the internal electrode 19 through the tubular conveyance element 42.

From said inner cavity 58, in fact, the conveyance and expulsion means 59 convey towards the outside the fourth flow F4 that is constituted by the heated air coming from the cavity 25 of the electrode 19.

The conveyance and expulsion means 59 preferably comprise radial ducts 60*a*, 60*b* that connect the inner cavity 58 of the piston 17 to an annular chamber 61 defined on the external surface of the piston 17.

The two ducts 60*a* and 60*b* are partially visible in FIGS. 3, 4, 5 and 7 thanks to the particular section plane III-III selected, while in FIG. 6 it is possible to observe the right duct 60*b* in its entirety, thanks to the different section plane IV-IV selected.

A first outlet way 62 created in the centre bushing 18 conveys the air from the annular chamber 61 towards the second supporting body 12 and from there, through a further communication way 63 created in the supporting body 12, the air is finally conveyed towards the outside of the torch 1.

It should be noted that in different variant embodiments of the invention the various ducts that make up the communication ways for the air flows illustrated above can assume shapes and positions different from those illustrated and described herein.

Analogously, also the number of said ducts may be different from the number of ducts indicated herein.

Advantageously, according to the present invention, the fourth flow F4 of heated air coming from the cavity 25 of the internal electrode 19 is sent out and no more directed towards the striking area as it happens in the torches of known type.

The conveyance and expulsion means 59 convey the heated air coming from the cavity 25 in such a way as to avoid any interference with the striking area defined between the nozzle 20 and the electrode 19.

In this way, the cooling efficiency for cooling the internal electrode 19 is improved.

Also the cooling efficiency for cooling the nozzle 20 is improved compared to the torches of known type.

The above results in reduced wear of the electrodes 20, 19, in particular of the internal electrode 19, with reduced need for maintenance and/or replacement operations. Advantageously, also the costs related to maintenance and/or electrode replacement are reduced compared to those involved when using torches of the known type.

In the embodiment illustrated herein, advantageously, the flow of heated air, that is, the fourth flow F4 coming from the cavity 25 of the internal electrode 19 is sent out completely. In variant embodiments of the invention, however, part of said flow can be ejected towards the outside, while part of it can be directed again towards the striking area, that is, between the nozzle 20 and the second electrode 19, through suitable canalizations. This part of flow of heated air will substantially be added to the third flow F3 that already reaches the striking area between the nozzle 20 and the internal electrode 19.

The operation described above with the generation of plasma by the torch 1 continues as long as the torch is fed by the air flow (carrier gas) coming from the first duct 51, that is, as long as the torch 1 is in its second operating configuration. In the moment when the air flow coming from the first duct 51 is interrupted, for example by deactivating the switch 3, the thrusting force on the annular edge 40 of the piston 17 is reduced and the spiral spring 26 exerts its thrusting force bringing the torch 1 to the first operating configuration with the piston 17 and the internal electrode 19 in non-striking position, as explained above.

Figure 8:
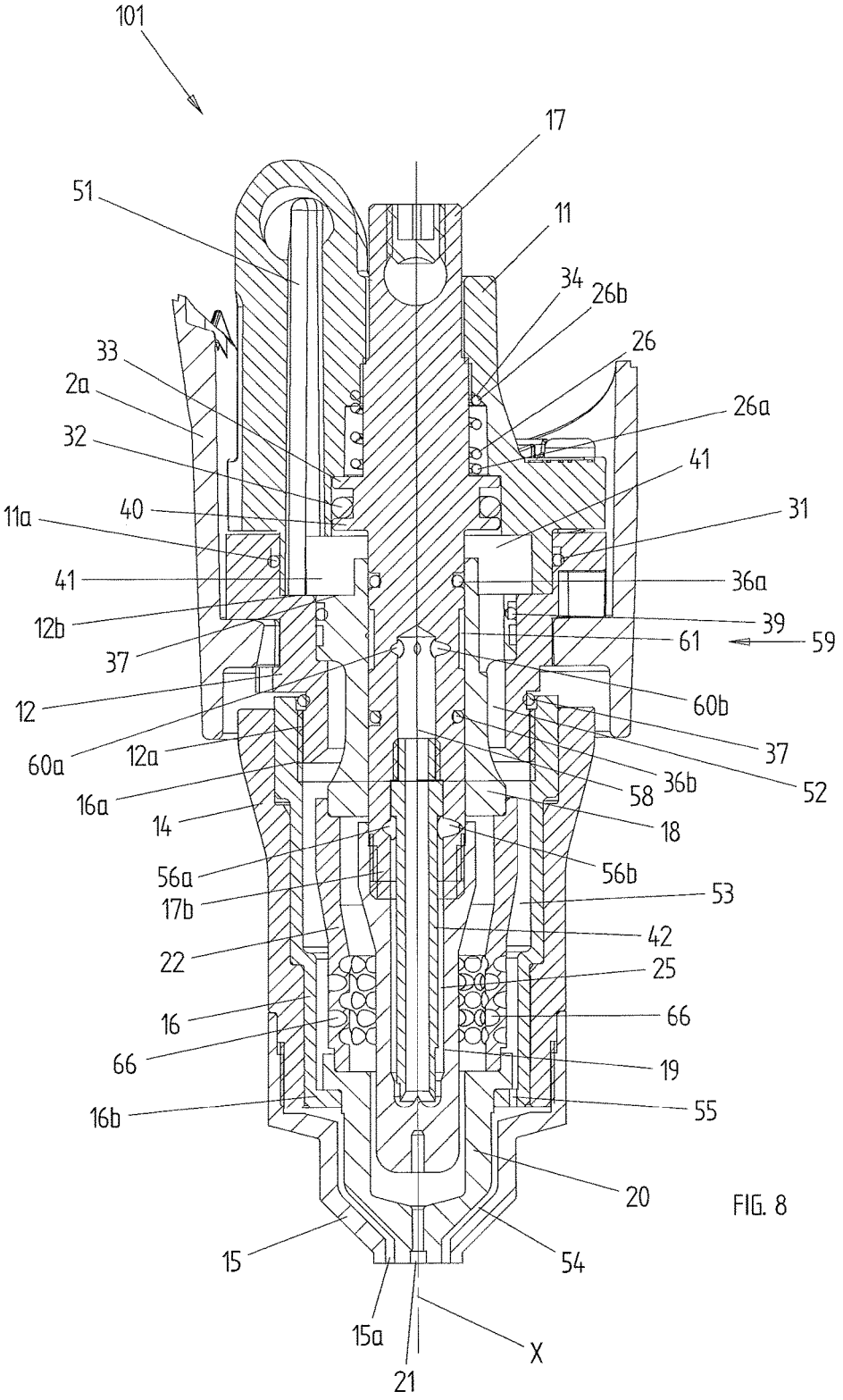
FIG. 8 shows a variant embodiment of FIG. 4.

With reference to FIG. 8, it is possible to observe a variant embodiment of the torch 101 according to the present invention.

Said torch 101, also known as torch with high-frequency striking, differs from the torch described above in that the internal electrode 19 and the nozzle 20 are maintained at the fixed striking distance, as shown in the figure.

In the embodiment described herein, this is obtained starting from a torch 1 of the type described above and locking the movement of the piston 17. The locking of the piston 17 is preferably obtained, for example, through a locking ring (not shown in the figure) interposed between the piston 17 and the first supporting body 11. In variant embodiments of the invention, however, the locking of the piston 17 can be obtained in a different manner and by any expert in the art. Obviously, the spiral spring 26 in this case will have no function (and may even be absent). This solution, however, makes it possible to obtain a single type of torch that can be easily adapted to be used according to one of the two intended modes.

To generate the plasma jet that is sent out of the nozzle 20, the carrier gas is conveyed and the two electrodes 20, 19 are properly powered to generate an alternating electric field and therefore a high-frequency jump spark between them.

The movements of the air flows in this embodiment are the same illustrated with reference to the preceding embodiment.

Figure 9:
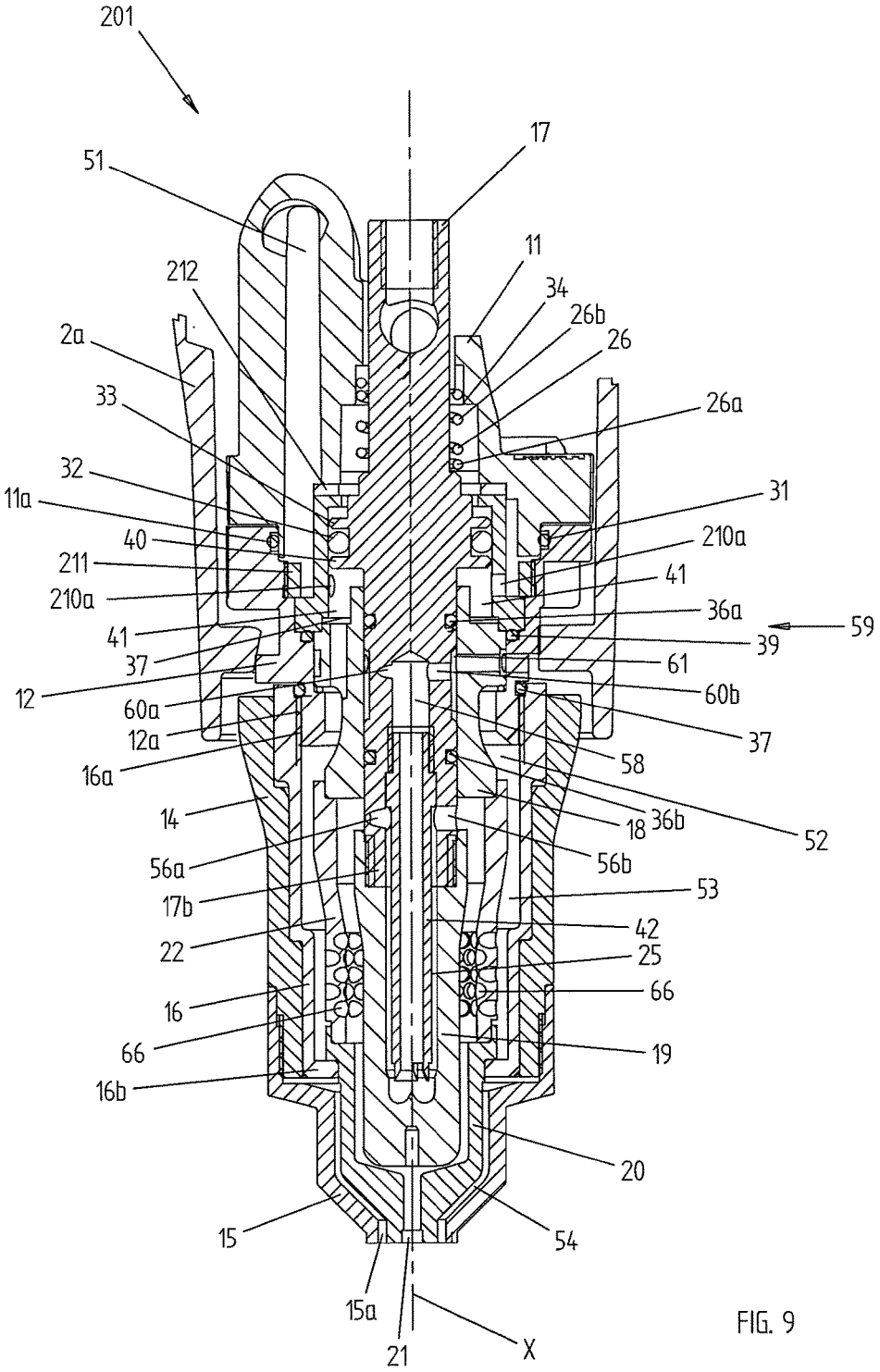
FIG. 9 shows a variant embodiment of FIG. 2.
Figure 10:
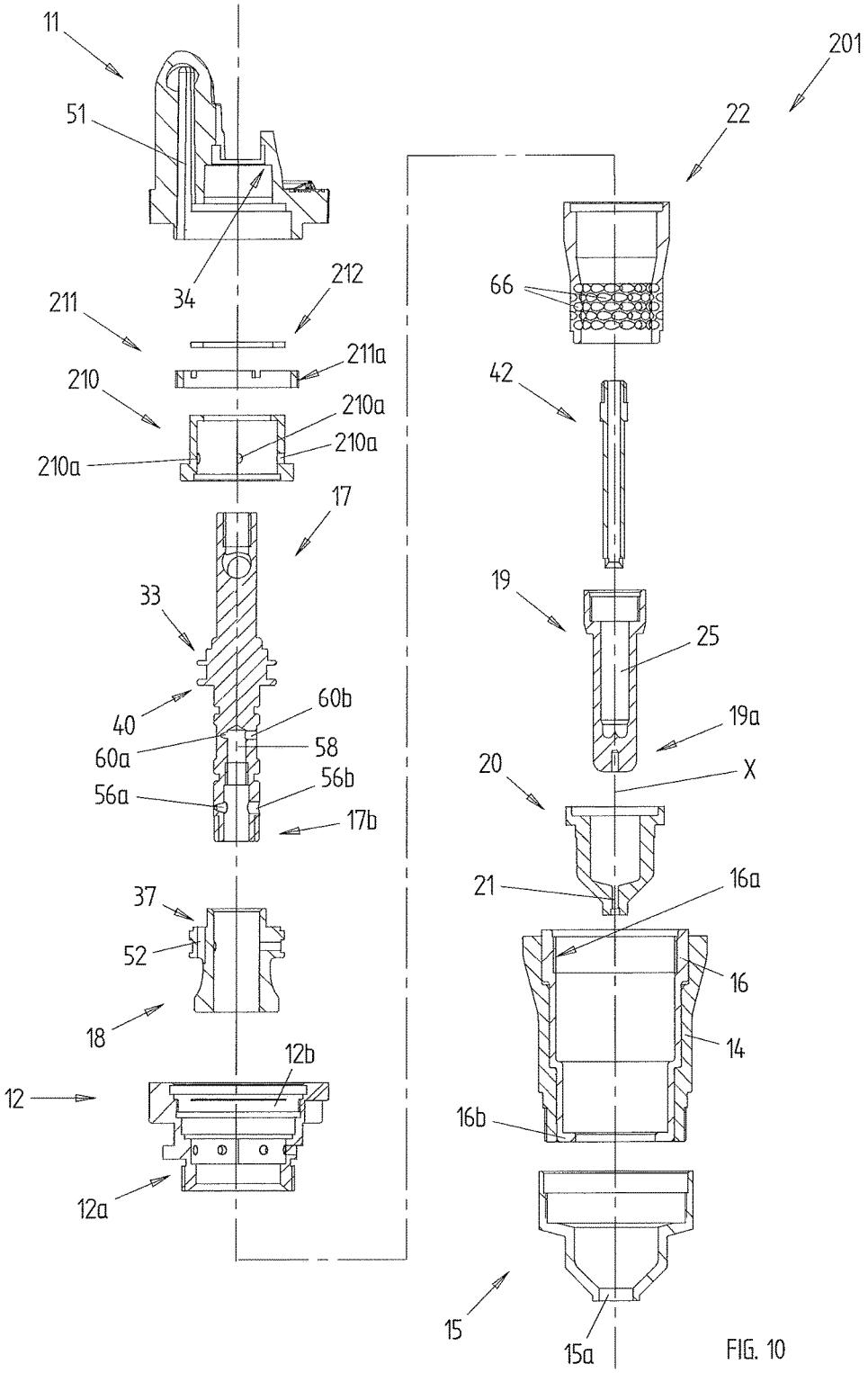
FIG. 10 shows an exploded view of FIG. 9.

FIGS. 9 and 10 show another variant embodiment of the torch 201 according to the present invention.

Said torch 201 differs from the torch previously described with reference to Figures from 1 to 7 in that further elements are used which are intended to improve the tightness to air flows and to reduce the wear caused by the translation movement of the piston.

For this purpose, in the upper part of the torch 201 a sliding element 210, in which the piston 17 slides, is interposed between the piston 17, the first supporting body 11, the second supporting body 12 and the centre bushing 18.

The tubular sliding element 210 is preferably made of a material with a low friction coefficient and at the same time good resistance to high temperatures, like for example Vespel®.

The piston 17 slides inside said tubular sliding element 210.

The tubular sliding element 210 comprises at least one passage hole 210*a* intended to allow the passage of air from the first duct 51 towards the annular chamber 41.

In variant embodiments of the invention, however, the number and/or shape of the passage holes can be different from those described herein.

The tubular sliding element 210 is preferably maintained in a fixed position through the use of a metal ring 211. The metal ring 211 preferably comprises an external thread 211*a* suited to allow it to be screwed onto the second supporting body 12. The screwing of the metal ring 211 locks the tubular sliding element 210 between the second supporting body 12 and the centre bushing 18.

Finally, a sealing gasket 212 is interposed at the top between the tubular sliding element 210 and the first supporting body 11.

The movements of the air flows in this embodiment are the same illustrated with reference to the previous embodiments.

This variant embodiment, therefore, achieves the objects and advantages described above with reference to the first embodiment of the invention.

It has thus been shown by means of the present description that the torch according to the invention makes it possible to achieve the set objects. In particular, the torch according to the present invention makes it possible to improve the cooling efficiency compared to the systems used in the torches of known type.

Although the present invention has been illustrated above through the detailed description of some of its embodiments, shown in the drawings, the present invention is not limited to the embodiments described above and shown in the drawings; on the contrary, further variants of the described embodiments fall within the scope of the present invention, which is defined in the claims.

The invention claimed is:

1. A plasma torch (1; 101; 201) comprising:

(a) a nozzle (20) longitudinally aligned with an axis (X) and a through opening (21) suitable for use as an outlet for a plasma flow;

(b) a hollow electrode (19) positioned coaxially with the axis (X) and having a first end positioned proximal to the through-opening (21) of the nozzle (20) said hollow electrode (19) comprising an inner cavity (25) that extends at least partially along the axis (X);

(c) a first passageway (51, 52, 53) adapted to convey a carrier gas from a first duct (51) to an air space (53);

(d) a second passageway (56, 56*a*, 56*b*) adapted to convey a portion of said carrier gas from said air space (53) towards an outlet (60*a*, 60*b*) via said inner cavity (25) of said hollow electrode (19), and (e) a third passageway between the hollow electrode (19) and the nozzle (20) adapted to convey a portion of said carrier gas from said air space (53) towards through-opening (21), wherein the second passageway (56, 56*a*, 56*a*) is not in carrier gas flowable connection with the third passageway between said inner cavity (25) of said hollow electrode (19) and said outlet (60*a*, 60*b*).

2. The plasma torch (1; 101; 201) according to claim 1, wherein said plasma torch (1; 101; 201) further comprises a cap (15) for the nozzle (20) positioned coaxial with, and proximal to, said nozzle (20) having an opening for said nozzle (20), wherein said nozzle (20) and said cap (15) have a fourth passageway (55) therebetween which is in carrier gas flowable connection with said air pace (53) for conveying a portion of said carrier gas from said air space (53) out of the plasma torch (1; 101; 201).

3. The plasma torch (1; 101; 201) according to claim 2, wherein said fourth passageway is not in carrier gas flowable connection with either said second passageway (56, 56*a*, 56*b*) or said third passageway at any location along the fourth passageway downstream from said air space (53).

4. The plasma torch (1; 101: 201) according to claim 1, wherein said hollow electrode (19) constitutes a cathode of said plasma torch (1; 101; 201).

5. The plasma torch (1; 101; 201) according to claim 1, wherein said hollow electrode (19) constitutes a cathode of said plasma torch (1; 101; 201) and said nozzle (20) constitutes an anode of said plasma torch (1; 101; 201).

6. The plasma torch (1; 201) according to claim 1, wherein said hollow electrode (19) can be moved and can be positioned between at least one first operating position and at least one second operating position, wherein in said first operating position said hollow electrode (19) is in contact with said nozzle (20) and in said second operating position said hollow electrode (19) is spaced apart from said nozzle (20) in such a manner as to define a striking area.

7. The plasma torch (1; 201) according to claim 6, wherein the plasma torch (1; 201) comprises a moving device (17, 26) adapted to move said hollow electrode (19) between said at least one first operating position and said at least one second operating position.

8. The plasma torch (1; 201) according to claim 7, wherein said moving device (17, 26) comprises at least one supporting piston (17) adapted to support said hollow electrode (19) and elastic thrusting device (26) adapted to thrust said piston (17) and to arrange said hollow electrode (19) in said at least one first operating position.

9. The plasma torch (101) according to claim 1, wherein said hollow electrode (19) is in a fixed position with respect to said nozzle (20).

10. The plasma torch (1; 101; 201) according to claim 1, wherein the inner cavity (25) of said hollow electrode (19) substantially extends over an entire length of said hollow electrode (19).

11. The plasma torch (1; 101; 201) according to claim 1, wherein the plasma torch comprises a power supply for supplying power to said hollow electrode (19).

12. The plasma torch (1; 101; 201) according to claim 1, wherein it comprises a power supply for supplying power to said first element (20).

13. A device for generating plasma comprising a plasma torch (1; 101; 201) according to claim 1 mounted within a first supporting body (11) and a second supporting body (12) coupled to the first supporting body (11).

14. A method for operating a plasma torch (1; 101; 201) comprising:

(a) providing a plasma torch (1; 101; 201) comprising:

a nozzle (20) positioned coaxially with an axis (X) and provided with a through opening (21) serving as an outlet for a plasma flow;

a hollow electrode (19) positioned coaxially with the axis (X) and comprising an inner cavity (25) that extends at least partially along said main axis (X);

a first passageway (51, 52, 53) adapted to convey a carrier gas;

a second passageway (56, 56*a*, 56*b*) adapted to convey a portion of said carrier gas from said first passageway (51, 52, 53) towards said inner cavity (25) of said hollow electrode (19), said portion of said carrier gas being adapted to cool said hollow electrode (19);

a third passageway between the hollow electrode (19) and the nozzle (20) adapted to convey a portion of said carrier gas from said first passageway (51, 52, 53) towards through opening (21);

(b) conveying said carrier gas through said first passageway (51, 52, 53);

(c) conveying a first portion of said carrier gas from said first passageway towards said inner cavity (25) of said hollow electrode (19) via said second passageway (56, 56*a*, 56*b*);

(d) conveying a second portion of said carrier gas from said first passageway towards the through opening (21) via said third passageway; and (e) expelling the first portion and the second portion from the plasma torch (1; 101; 201), wherein the first portion of said carrier gas is not comingled with the second portion of said carrier gas prior to expelling the first portion and the second portion from the plasma torch (1; 101; 201) after the carrier gas has been separated into the first portion and the second portion.

* * * * *